United States Patent [19]

Bentzien

[11] 4,272,895

[45] Jun. 16, 1981

[54] PRODUCT RECLAMATION IN A FLUID BED DRYER

[75] Inventor: Len Bentzien, Menomonie Falls, Wis.

[73] Assignee: Universal Foods Corporation, Milwaukee, Wis.

[21] Appl. No.: 92,216

[22] Filed: Nov. 7, 1979

[51] Int. Cl.[3] ..... F26B 3/08

[52] U.S. Cl. ..... 34/10; 34/57 A; 34/57 D

[58] Field of Search ..... 34/57 A, 57 D, 10; 432/15, 58; 110/245

[56] References Cited

U.S. PATENT DOCUMENTS

| | | | |
|---|---|---|---|
| 3,305,939 | 2/1967 | Sonnenschein et al. | 34/57 A |
| 3,306,236 | 2/1967 | Campbell | 34/57 A |
| 3,849,900 | 11/1974 | Dale et al. | 34/57 D |
| 4,051,603 | 10/1977 | Kern, Jr. | 34/57 A |

*Primary Examiner*—Larry I. Schwartz

*Attorney, Agent, or Firm*—Neuman, Williams, Anderson & Olson

[57] ABSTRACT

A fluid bed dryer utilizing a rotating air distribution disc to deliver rotating streams of air to the fluid bed includes salvage apparatus which accumulates, concentrates and returns particulate material which falls from the fluid bed during the drying operation to the fluid bed. A salvage ring is mounted below and completely encircles the disc to receive and accumulate particles of material which fall from the fluid bed to the disc and are flung from the disc by centrifugal force. A collector which is positioned within the salvage ring and driven by the disc, sweeps the internal area of the salvage ring to concentrate the accumulated particles of material and deliver them to a funnel which is connected to a passageway leading back to the fluid bed. The collected particles of material are returned to the fluid bed by air pressure created by pressure differentials within the dryer apparatus.

16 Claims, 5 Drawing Figures

PRODUCT RECLAMATION IN A FLUID BED DRYER

BACKGROUND OF THE INVENTION

This invention relates to fluid bed dryers and more particularly to a method and apparatus for salvaging product which is otherwise wasted in a fluid bed dryer utilizing a rotating air distribution disc to deliver rotating streams of air to the fluid bed.

Fluid bed dryers are used for drying particulate material by passing streams of fluidizing gases through a bed of material in a so-called fluidizing chamber. Fluid bed dryer operation involves passing sufficient air or other fluid through the chamber to suspend solid particles in a stream of air. If each particle is bathed with a stream of air to produce the so-called "fluid bed", rapid drying throughout the entire mass is achieved.

The fluidizing chambers are frequently cylindrical in form and have perforate or screen-like bottom portions which have holes sufficiently small to retain the particulate material while permitting air or other fluid to flow therethrough. The selection of a hole size requires a compromise between a small hole size which would retain nearly all of the particulate material being dried but unduly restrict air flow and a large hole size which would allow less restricted air flow but allow considerable material to fall from the chamber. This compromise usually results in the selection of a hole size which allows adequate air flow while retaining a large majority of the material but allowing very small particles of the material to fall through the screen.

Of particular interest to the present invention is an improved fluid bed dryer as disclosed in U.S. Pat. No. 3,849,900. The improved fluid bed dryer of this patent is characterized by the use of a rotating apertured disc positioned below and out of contact with the product to be dried. The disc delivers a stream or streams of air moving in rotary fashion throughout the fluidizing chamber. This improved drying apparatus eliminates localized heavy streams of air which tend to develop in other prior art fluidizing chambers and avoids mechanical agitation and contact with the particles which is undesirable in many instances where particles tend to crush, smear, or agglomerate, e.g., in the case of cheese particles.

Although the rotating disc dryer is a notable improvement over prior art fluid bed dryers, it does cause increased amounts of product to fall through the screen-like bottom portion of the fluidizing chamber. This product is generally lost since it is difficult to recover and is often spoiled due to contamination at the bottom of the dryer.

SUMMARY OF THE INVENTION

The present invention relates to an improvement in the rotating disc fluid bed dryer to allow salvage of the particles of product which fall from the fluidizing chamber to the rotating disc where they are thrown to the bottom of the dryer and contaminated. More particularly, in accordance with the present invention, an improvement of the rotating disc fluid bed drying apparatus comprises accumulator means for accumulating particles of material to be dried which fall from the fluidizing chamber to the rotating disc; passage means for interconnecting the accumulator means and the fluidizing chamber; and collector means for concentrating particles of material accumulated in the accumulator means and for transferring the concentrated particles to the passage means.

A method of salvaging what is otherwise waste product in a fluid bed dryer which includes a rotating air distribution disc is also provided and comprises mounting a product collector around the periphery of the disc, accumulating in the collector what is otherwise waste product which falls on the disc during the drying operation, concentrating the product accumulated in the collector, and transferring the accumulated product from the collector to the fluid bed chamber.

Apparatus in accordance with the present invention salvages more than 90% of what otherwise would be wasted product. An additional advantage of the salvage apparatus is improved performance of the fluid bed dryer since air flow through the dryer is not restricted by the buildup of waste product in the bottom of the dryer. Another advantage is the virtual elimination of the time-consuming, manual clean-out operations periodically required to remove the waste product from the bottom of the dryer and to dispose of the waste product so removed.

BRIEF DESCRIPTION OF THE DRAWING

The invention will be better understood from the following description of the preferred embodiment when read with reference to the drawing in which.

It should be understood that the drawings are not necessarily to scale and that in certain instances, details which are not necessary for an understanding of the present invention or which render other details difficult to perceive may have been omitted. It also should be understood that the invention is not necessarily limited to the particular embodiment illustrated herein.

DESCRIPTION OF THE PREFERRED EMBODIMENT

Figure 1:
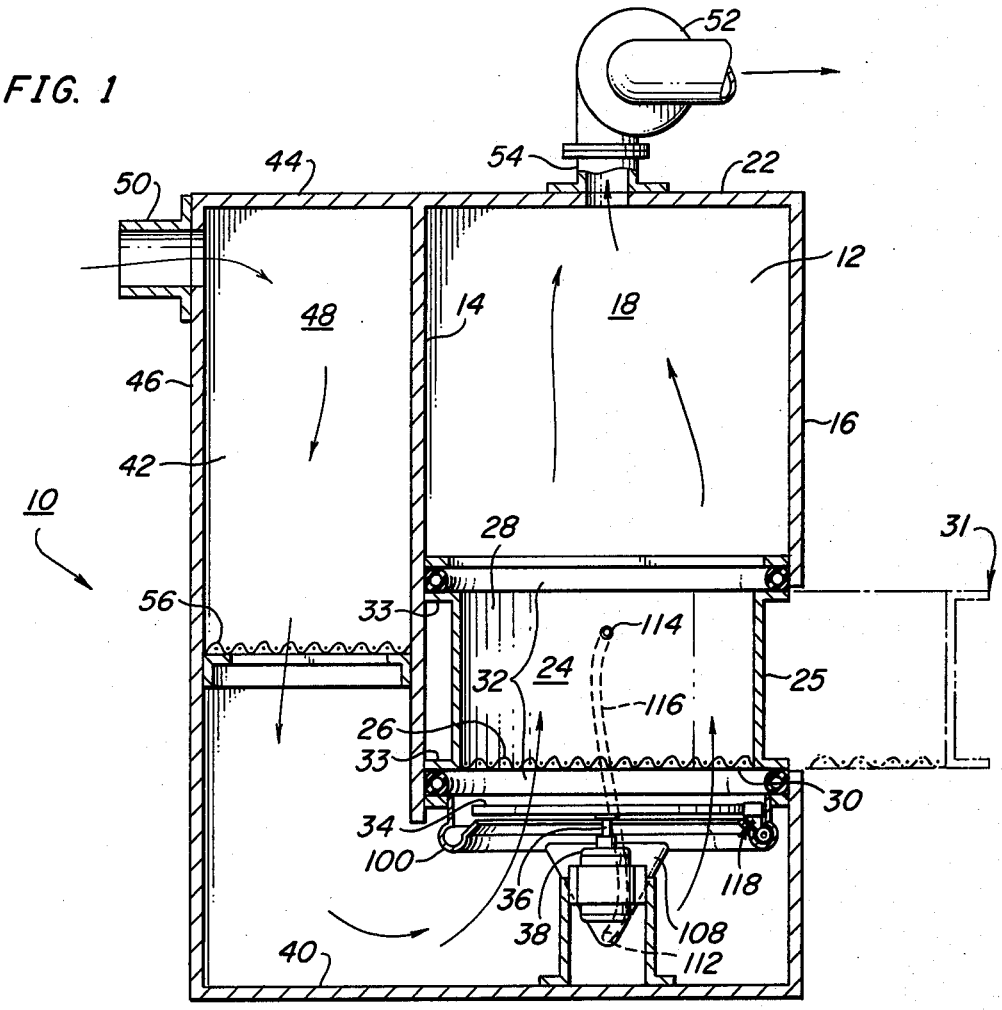
FIG. 1 is a schematic vertical elevation side view in section of the rotating disc fluid bed dryer including the salvage apparatus of the present invention.

Referring to FIG. 1 of the drawing, there is shown in side elevation schematic section, a fluid bed apparatus 10 comprising an exhaust plenum 12 in the form of an elongated rectangular chamber defined by sidewalls 18 and 20 (see FIG. 2), rear wall 14, front wall 16 and top wall 22. It is to be understood that in actual use, wall 16 is usually considered the "front" of the apparatus from the point of view of the operator. A removable product containing fluid bed chamber 24 having sidewall 25 is cylindrical in shape and has an air inlet end 26 and an air outlet end 28. The fluid bed chamber 24 has a screen-like retaining member 30 at the inlet end 26 and is adapted to be removably placed directly under the exhaust plenum 12 when the fluid bed apparatus is in operation. The chamber 24 is removable from the apparatus 10 and rests on tracks or other support means (not shown). The chamber in the partially removed position is shown in broken line as 31 of FIG. 1.

Portions of the front wall 16, the sidewall 18 and the sidewall 20 are left open. The open construction facilitates the insertion and removal of the chamber 24 in the fluid bed dryer apparatus. Chamber 24 is sealed into place in the apparatus 10 by means of the inflatable seals 32 which abut the flanges 33 extending outwardly from the sidewall 25 at the inlet and outlet ends of the chamber 24. The inflatable seals are in the form of rubber tubular rings in the toroidal form of automobile inner tubes. When the seals 32 are collapsed, the chamber 24 is readily inserted or withdrawn. When the seals 32 are inflated, they press and seal the space between the apparatus 10 and the chamber 24 to hold the chamber in place in the apparatus and to minimize air loss from the apparatus.

A plate or disc structure 34 is mounted below the retaining member 30 and is approximately the same size as the retaining member which forms the bottom of the chamber 24. The disc 34 is mounted for rotation just adjacent and below the retaining member 30 at the inlet end 26 of the chamber 24. The mounting comprises affixing the disc 34 at its center to the shaft 36 of the motor 38 or other drive means which is affixed to and supported by the base 40. The motor 38, when activated, rotates its shaft 36 to spin the disc 34 at a predetermined speed.

The apparatus 10 is provided with the inlet plenum 42 comprising the top wall 44, the rear wall 46 and the front wall 14, which latter is a common wall with the exhaust plenum 12, the sidewall 48 also common with the sidewall 18 of the exhaust plenum 12, and the sidewall (not shown) which may also be common with the sidewall 20 (see FIG. 2) of the chamber 12. The common bottom wall 40 is provided and also serves as a support base for the apparatus 10.

The outlet duct 54 is provided with the cooperating fan 52 which serves to draw air or other gas through the inlet duct 50 and into the inlet plenum 42 in the direction of the arrows, through the rotating disc 34 and the retaining member 30, through the chamber 24, through the exhaust plenum 12 and out through the outlet duct 54. If desired, the fan 52 may be placed at the inlet duct 50 and push air through the apparatus. A screen or dust filter 56 is provided to remove undesirable particles from the incoming air.

Figure 2:
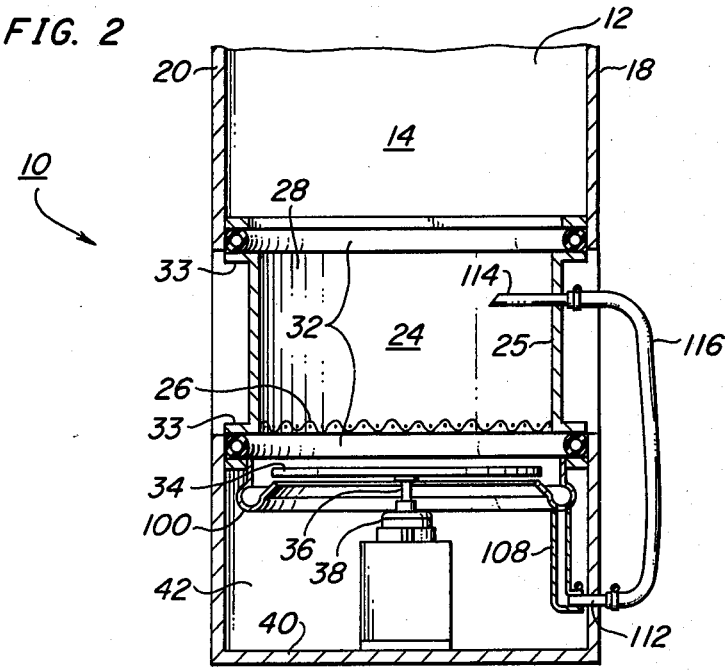
FIG. 2 is a schematic vertical elevation front view in section of the rotating disc fluid bed dryer equipped with the salvage apparatus of the present invention.

The fluid bed apparatus 10 of FIGS. 1 and 2 includes the salvage apparatus in accordance with the present invention. The salvage ring 100 is mounted below and completely surrounds the disc 34. Details of the construction of the salvage ring or trough are shown in the perspective view of FIG. 3 and the cross sectional view of FIG. 4. The salvage ring can be formed by rolling stainless steel tubing into a closed circular form having a diameter which is slightly larger than that of the disc 34. The open slot 102 is cut into the ring of stainless steel tubing and the flanges 104 and 106 are attached. A section of the lower portion of the salvage ring 100 is cut away to form the hole 107 around which the funnel 108 is attached to receive material which falls through the hole 107. The funnel 108 tapers downwardly to the outlet 110.

With reference to FIG. 2, when the salvage ring is installed in the apparatus 10, the outlet of the funnel 108 is connected to the tube 112 which passes through the wall 18 and is sealed to the wall 18 to prevent air leakage. The tube 112 is connected to the tube 114, which similarly passes through the sidewall of the chamber 24 and is sealed thereto, by the flexible plastic tubing 116. Material which falls into the funnel 108 flows through the funnel outlet 110, and tube 112, the plastic tubing 116 and the tube 114 to be deposited into the fluidizing chamber 24. The material is propelled through this passageway by air pressure created by the pressure differentials between the inlet plenum 42 and the fluidizing chamber 24.

Figure 3:
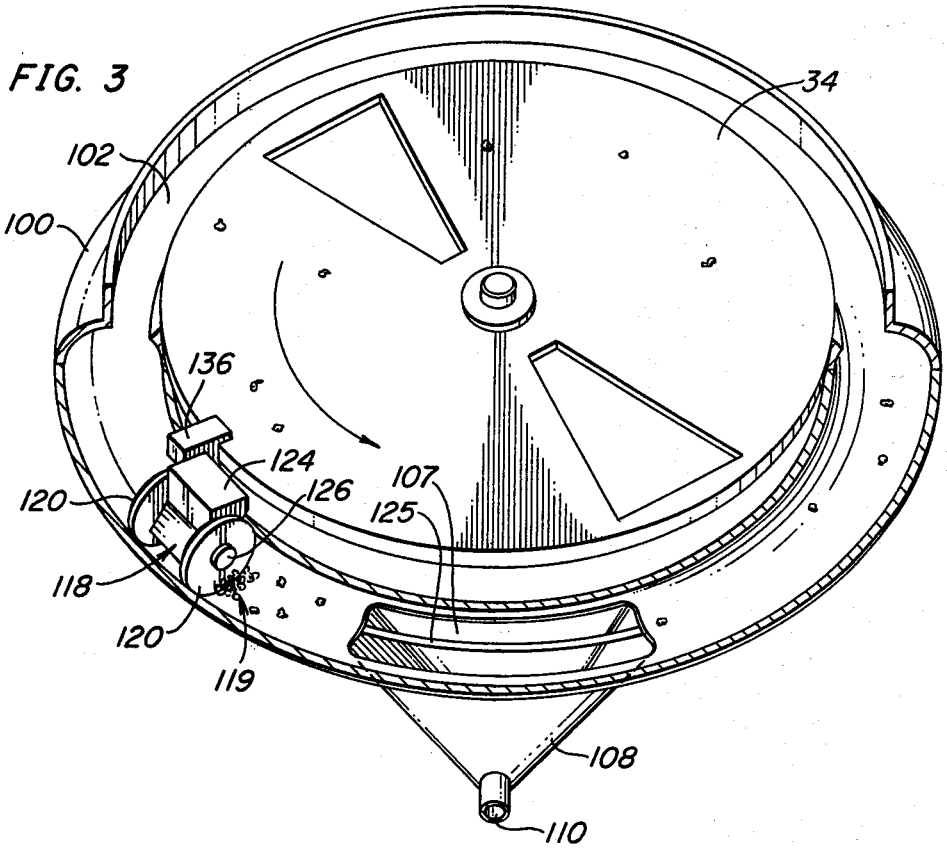
FIG. 3 is a partially sectioned perspective view of the air distribution disc and the salvage ring of the present invention.
Figure 4:
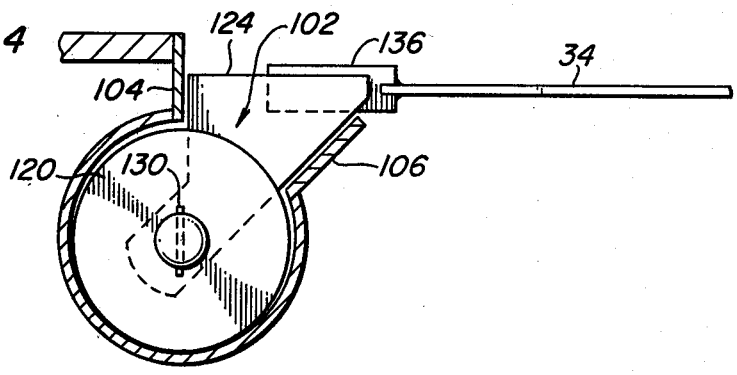
FIG. 4 is a cross section of the salvage ring showing the collector of the present invention.

The salvage ring 100 is mounted below and surrounds the disc 34 as shown in FIGS. 1, 2, 3 and 4. The salvage ring 100 is positioned relative to the disc 34 such that material which falls from the fluidizing chamber 24 onto the disc 34 is flung from the edge of the disc 34 into the slot 102 of the salvage ring 100. This material collects or accumulates in the salvage ring 100. The collector 118 collects or concentrates the accumulated material in the salvage ring 100 represented by the particles 119 in FIG. 3 and passes it to the funnel 108 for return to the fluidizing chamber 24. The collector 118 is shown in FIGS. 1 and 3 and an illustrative detailed construction for the collector 118 is shown in FIGS. 4 and 5.

Figure 5:
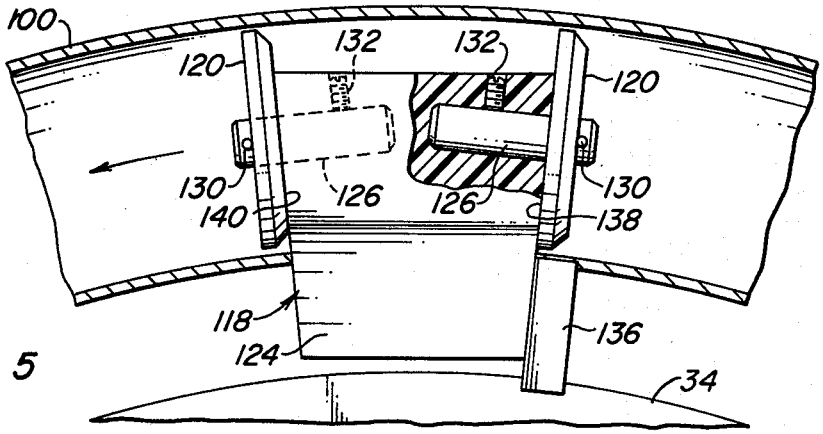
FIG. 5 is a lateral section of the salvage ring showing a detailed construction for the collector.

Referring to FIG. 5, an illustrative embodiment of the collector 118 comprises the two collector discs 120, the disc support 124, and the two disc mounting pins 126. Near the end of each disc mounting pin is a hole through the pin to receive a disc retainer 130. The disc mounting pins are retained in the disc support 124 by set screws 132 which are tightened within tapped holes in the disc support 124. The collector 118 is positioned in and moved around the salvage ring 100 to collect the material accumulated in the salvage ring and to deposit it in the funnel 108 each time it passes thereover. The retaining rod 125 is positioned across the hole 107 to prevent the collector 118 from falling into the funnel 108 (see FIG. 3). The collector discs 120 are beveled on the side away from the direction of movement of the collector 118 which is indicated by the arrows in FIGS. 3 and 5. The end surfaces 138 and 140 of the disc support 124 are not parallel but diverge slightly from one another. When the disc mounting pins are inserted into mounting holes which are perpendicular to the end surfaces of a disc support constructed in this manner, the discs sweep an area which more closely conforms to the interior of the salvage ring 100. The disc support 124 is sufficiently long, i.e., the distance between the end surfaces 138 and 140, such that the discs are separated by a suitable distance to stabilize the collector 118 as it travels within the salvage ring 100.

Although other drive arrangements could be provided, it is convenient to drive the collector 118 from the disc 34 which is already rotating to provide rotary air streams to the fluidizing chamber 24. To this end, a lug 136 is welded or otherwise attached to the disc 34 in such a position that the lug 136 maintains contact with the disc support 124 as the disc 34 rotates (see FIG. 4). By this arrangement, the lug 136 pushes the collector 118 around the salvage ring 100 as the disc 34 rotates. Accordingly, each time the disc 34 makes one revolution, the collector 118 makes one sweep through the salvage ring 100 collecting the accumulated material and depositing it in the funnel 108.

In a typical drying operation, the chamber 24 containing material to be dried is inserted into the apparatus 10. The inflatable seals 32 are inflated to hold the chamber in place and to seal the chamber to the apparatus 10. The fan 52 is activated to draw air through the fluidizing chamber 24 which creates a pressure differential between the inlet plenum 42 and the exhaust plenum 12. The motor 38 is also activated to rotate the disc 34 to create rotating air currents through the fluidizing chamber 24. As the drying progresses, particles of the material in the fluidizing chamber 24 fall to the disc 34 and are thrown into the salvage ring 100 by the centrifugal force created by the rotation of the disc 34. The collector 118 which is pushed by the lug 136 on the disc 34 sweeps the interior area of the salvage ring 100 to collect the material which accumulates in the salvage ring and to pass it to the funnel 108 where air pressure differentials return the material to the fluidizing chamber 24. Accordingly, material which is ordinarily lost due to contamination in the bottom of the dryer apparatus 10 is salvaged and recycled into the product contained in the fluidizing chamber 24. Apparatus in accordance with the invention salvages more than 90% of the material which falls from the fluidizing chamber during the drying operation and must ordinarily be scrapped due to contamination.

It should be understood that other embodiments may be employed such as a differently shaped salvage ring, an alternate drive for the collector, a different collector arrangement or the like, without detracting from the inventive concept as disclosed herein.

What is claimed is:

1. In a fluidized bed apparatus for drying of particulate material which comprises a vertically disposed fluidizing chamber, means for passing a current of air through said fluidizing chamber, and an apertured disc shaped element rotatably mounted in a second chamber below said fluidizing chamber and adapted to interrupt a current of air passing through said fluidizing chamber, the improvement comprising:

accumulator means disposed in said second chamber and surrounding said disc shaped element for accumulating particles of said material which fall upon said disc shaped element;

passing means for interconnecting said second chamber and said fluidizing chamber; and collector means coupled to said accumulator means for concentrating and transferring said particles to said passage means.

2. In a fluidized bed apparatus for drying of particulate material which comprises a vertically disposed fluidizing chamber, means for passing a current of air through said fluidizing chamber, and an apertured disc shaped element rotatably mounted in a second chamber below said fluidizing chamber and adapted to interrupt a current of air passing through said fluidizing chamber, the improvement comprising:

accumulator means disposed in said second chamber for accumulating particles of said material which fall from said fluidizing chamber, said accumulator means comprising an annular trough disposed around the circumference of said disc and adapted to receive particles falling on said disc surface that are flung into said accumulator means by centrifugal forces generated by the rotation of said disc shaped element;

passage means for interconnecting said second chamber and said fluidizing chamber, said passage means comprising conduit means for transferring particles from said accumulator means in said second chamber to said fluidizing chamber; and collector means coupled to said accumulator means for concentrating and transferring said particles to said passage means.

3. The improvement in accordance with claim 2 wherein said collector means comprises sweeper means disposed in said accumulator trough which is mechanically coupled with said disc, said sweeper means being slidably fitted for sweeping annular movement within said accumulator trough.

4. In a fluidized bed apparatus for drying of particulate material which comprises a vertically disposed fluidizing chamber, means for passing a current of air through said fluidizing chamber, and an apertured disc shaped element rotatably mounted in a second chamber below said fluidizing chamber and adapted to interrupt a current of air passing through said fluidizing chamber, the improvement comprising:

accumulator means disposed in said second chamber for accumulating particles of said material which fall upon said disc shaped element;

passage means for interconnecting said second chamber and said fluidizing chamber;

funnel means connected to said accumulator means for funneling said accumulated particles to said passage means; and sweeper means for sweeping the inside of said accumulator means to concentrate said accumulated particles and to pass the concentrated particles to said funnel means.

5. In a fluidized bed apparatus for drying of particulate material which comprises a vertically disposed fluidizing chamber, means for passing a current of air through said fluidizing chamber, and an apertured disc shaped element rotatably mounted in a second chamber below said fluidizing chamber and adapted to interrupt a current of air passing through said fluidizing chamber, the improvement comprising:

accumulator means disposed in said second chamber for accumulating particles of said material which fall from said fluidizing chamber, said accumulator means comprising an annular shaped salvage trough having extending particle directing flange means, said salvage trough being positioned circumferentially in particle receiving relationship to said disc element such that particles falling on the disc surface are flung outwardly from the edge of said disc by rotation thereof and are accumulated in said salvage trough;

passage means for interconnecting said second chamber and said fluidizing chamber; and collector means coupled to said accumulator means for concentrating and transferring said particles to said passage means.

6. The improvement in accordance with claim 5 wherein said salvage trough has a generally circular cross section.

7. The improvement in accordance with claim 6 wherein said collector means comprises:

funnel means connected to said salvage trough for gravitationally receiving and directing said accumulated particles to said passage means;

an aperture communicating between said trough and said funnel means; and sweeper means for sweeping the inside of said trough means to concentrate said accumulated particles and to pass the concentrated particles through said aperture to said funnel means.

8. The improvement in accordance with claim 7 wherein said disc shaped element is frictionally engaged to and adapted to drive said sweeper means which comprises:

a wiper disc support element formed to fit within said salvage trough; and first and second wiper discs mounted on said support element, said support element providing sufficient separation between said first and second wiper discs to stabilize said sweeper means and maintain the wiper disc surfaces essentially normal to the rotational direction as the sweeper rotates within said salvage trough.

9. The improvement in accordance with claim 8 wherein said wiper disc support element is characterized in that the disc mounting surfaces thereof are formed to maintain said wiper discs mounted thereon in close conformation to the toroidal interior space of said salvage trough.

10. The improvement in accordance with claim 8 wherein each of said wiper discs have a beveled edge formed on the discs away from the direction of rotational movement of said sweeper means.

11. A fluidized bed apparatus for drying of particulate material which comprises:

a vertically disposed fluidizing chamber adapted to contain a product for drying, said chamber having air inlet and outlet passage means;

means for passing a current of air through said fluidizing chamber;

an apertured disc shaped element rotatably mounted below said fluidizing chamber and adapted to interrupt a current of air passing through said chamber; and means for rotating said disc to direct currents of air in rotating fashion through the product in said chamber characterized in that said apparatus further comprises:

a salvage ring surrounding said disc for accumulating particles of material which fall upon said disc and are centrifugally dispersed by the rotation thereof;

passage means for conducting said particles accumulated by said salvage ring to said fluidizing chamber; and collector means for concentrating said particles and delivering particles to said passage means.

12. The apparatus in accordance with claim 11 wherein said passage means includes a funnel connected to said salvage ring.

13. The apparatus in accordance with claim 11 wherein said collector means comprises sweeper means for sweeping the area inside said salvage ring to collect accumulated particles and to pass them to said passage means.

14. The apparatus in accordance with claim 13 wherein said sweeper means is driven by said disc.

15. A process for salvaging otherwise waste product in a fluidized bed dryer for drying a particulate product by passage of a current of air through a fluidizing chamber to fluidize the particulate product to be dried and contained therein under fluid bed drying conditions, which includes passing a rotating current of air through the fluidized bed to maintain a rotating wave form therein by a rotating air apertured distribution disc mounted below the fluidized bed adapted to interrupt a current of air passing upwardly through said fluidizing chamber and a collector ring surrounding the periphery of said disc, the improvement comprising:

(a) accumulating particulate product which falls from said fluidized bed onto said disc in said collector;

(b) concentrating the accumulated particulate product in said collector; and (c) transferring the concentrated accumulated particulate product accumulated in said collector ring to the fluidized bed by a conduit means.

16. A process for salvaging otherwise waste product in a fluidized bed dryer for drying a particulate product by passage of a current of air through a fluidizing chamber to fluidize the particulate product to be dried and contained therein under fluid bed drying conditions, which includes passing a rotating current of air through the fluidized bed to maintain a rotating wave form therein by a rotating air apertured distribution disc mounted in a second chamber below the fluidized bed and adapted to interrupt a current of air passing upwardly through said fluidizing chamber, conduit means interconnecting said fluidizing chamber and said second chamber, and a collector ring surrounding the periphery of said disc, the improvement comprising:

(a) accumulating particulate product which falls from said fluidized bed onto said disc in said collector;

(b) rotating a sweeper element in said collector to concentrate the accumulated particulate product in said colle (c) discharging the accumulated concentrated particulate product from the collector ring to the conduit means; and (d) transferring the concentrated accumulated particulate product accumulated in said collector ring to the fluidized bed via the conduit means by air pressure.

* * * * *

UNITED STATES PATENT AND TRADEMARK OFFICE

CERTIFICATE OF CORRECTION

PATENT NO. : 4,272,895

DATED : June 16, 1981

INVENTOR(S) : LEN BENTZIEN

It is certified that error appears in the above-identified patent and that said Letters Patent are hereby corrected as shown below:

In the specification, Column 2, line 3 the word --"of"-- should read --for--

Column 4, line 4, after "110," delete --"and"-- and insert --the-- in its stead

In the Claims, Claim 1, Column 5, line 39, the word --"passing"-- should read --passage--

Signed and Sealed this

*Twenty-second* Day of *September 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,272,895

DATED : June 16, 1981

INVENTOR(S) : LEN BENTZIEN

It is certified that error appears in the above-identified patent and that said Letters Patent are hereby corrected as shown below:

Column 3, line 39 after "draw"

insert --the--

In the Claims, Claim 16, Column 8, line 42, after "said"

--"colle"-- should read --collector--

Signed and Sealed this

*Fifteenth* Day of *December 1981*

[SEAL]

*Attest:*

GERALD J. MOSSINGHOFF

*Attesting Officer*

*Commissioner of Patents and Trademarks*